US006167733B1

(12) United States Patent
Lee

(10) Patent No.: US 6,167,733 B1
(45) Date of Patent: Jan. 2, 2001

(54) DRUM TYPE WASHING MACHINE HAVING A PUMP INTEGRALLY FORMED WITH A FILTER

(75) Inventor: Sang Dae Lee, Seoul (KR)

(73) Assignee: Daewoo Electronics Co., Ltd., Seoul (KR)

( * ) Notice: Under 35 U.S.C. 154(b), the term of this patent shall be extended for 0 days.

(21) Appl. No.: 09/291,982

(22) Filed: Apr. 15, 1999

(30) Foreign Application Priority Data

Jun. 30, 1998 (KR) ..... 98/11727 U
Jun. 30, 1998 (KR) ..... 98/11731 U

(51) Int. Cl.[7] ..... D06F 21/04; D06F 39/10
(52) U.S. Cl. ..... 68/18 F; 68/58
(58) Field of Search ..... 68/18 F, 58

(56) References Cited

U.S. PATENT DOCUMENTS 2,959,286 * 11/1960 Hickman ..... 68/18 F
3,332,259 * 7/1967 Zylstra ..... 68/18 F
4,580,421 * 4/1986 Babuin et al. ..... 68/58 X
4,833,900 * 5/1989 Babuin et al. ..... 68/18 F

FOREIGN PATENT DOCUMENTS

1191781 * 4/1965 (DE) ..... 68/18 F
761989 * 11/1956 (GB) ..... 68/58

* cited by examiner

*Primary Examiner*—Philip R. Coe
(74) *Attorney, Agent, or Firm*—Pillsbury Madison & Sutro LLP

(57) ABSTRACT

A drum type washing machine having a pump integrally formed with a filter. The drum type washing machine has a body, an outer tub disposed in the body for receiving a washing liquid therein, a drum formed at a side wall thereof with a plurality of discharging holes and disposed in the outer tub for receiving articles to be washed, a pump assembly which sprays the washing liquid onto the articles by circulating the washing liquid discharged from a lower portion of the outer tub to an upper portion of the outer tub, removes impurities from the washing liquid while a washing cycle is being carried out and drains the washing liquid out of the washing machine after the washing cycle is finished. The pump assembly has a pump, a filter installed at one side of the pump and a spraying nozzle assembly disposed above the drum.

8 Claims, 6 Drawing Sheets

DRUM TYPE WASHING MACHINE HAVING A PUMP INTEGRALLY FORMED WITH A FILTER

BACKGROUND OF THE INVENTION

1. Field of the Invention

The present invention relates to a drum type washing machine, and more particularly to a drum type washing machine having a pump integrally formed with a filter.

2. Prior Arts

As is well known, a drum type washing machine is an appliance for separating dirt from articles to be washed such as clothing by rotating a drum while spraying a washing liquid onto articles placed in the drum.

The drum type washing machine sequentially carries out various cycles in order of liquid feeding, washing, rinsing, dehydrating, and draining cycles.

While the above cycles are being executed, dirt contained in the articles separates from the articles by means of friction between a liquid flow and the articles or by means of detergents.

FIG. 1 shows such a conventional drum type washing machine 100. As shown in FIG. 1, conventional drum type washing machine 100 has a body 110 provided at an upper portion thereof with a control panel 112, an outer tub 120 contained in body 110, a drum 130 rotatably disposed in outer tub 120, a filter 140 provided below outer tub 120 and a pump 150 for circulating and draining the washing liquid.

A detergent box 114 for storing detergents 115 is installed at the upper portion of body 110. Detergent box 114 is connected to outer tub 120 through a water supplying tube 168. Accordingly, the washing liquid is supplied into outer tub 120 through water supplying tube 168 together with detergents 115.

Outer tub 120 has a cylindrical shape and is formed at one side thereof with an opening 124 which is opened and closed by a door 116. Drum 130 is formed at a circumference thereof with a plurality of holes 132. The washing liquid is flowed into drum 130 through the plurality of holes 132.

A rotating shaft of drum 130 is disposed at one side of outer tub 120 and is connected to a motor assembly 122 installed below outer tub 120. Accordingly, when the rotating shaft of drum 130 is rotated by motor assembly 122, drum 130 is also rotated.

Drum 130 is disposed at a center of outer tub 120 so that a space is formed between an outer circumference of drum 130 and an inner circumference of outer tub 120. When the washing liquid is supplied into outer tub 120 through water supplying tube 168, the washing liquid is flowed into the space through drum 130. Accordingly, drum 130 is partially submerged in the washing liquid.

Filter 140 is connected to a lower portion of outer tub 120 through a first drain tube 162 so as to remove impurities contained in the washing liquid discharged from outer tub 120.

Pump 150 is spaced at a predetermined distance apart from filter 140. Filter 140 is 20 connected to pump 150 through a second drain tube 164. In addition, a third drain tube 166 is connected to one side of pump 150.

Therefore, the washing liquid supplied into pump 150 through filter 140 is drained out of washing machine 100 through third drain tube 166.

When the washing liquid is supplied into outer tub 120, the washing liquid is flowed into drum 130 through the plurality of holes 132 formed at the outer circumference of drum 130 so that the washing liquid reaches a predetermined height in outer tub 120. At this time, the washing liquid is introduced into pump 150 through first drain tube 162 and filter 140.

In this state, if drum 130 rotates, the articles placed in drum 130 make contact with the washing liquid. Generally, it takes the articles five minutes to fully make contact with the washing liquid.

As drum 150 continuously rotates, the articles continuously make contact with the washing liquid so that the articles are washed. When the washing cycle has been completed, pump 150 is driven to drain the washing liquid contained in outer tub 120 out of washing machine 100 through first drain tube 162, filter 140, second drain tube 164, pump 150 and third drain tube 166.

However, the conventional drum type washing machine requires much time to allow the articles to fully contact with the washing liquid. For this reason, the washing time is unnecessarily prolonged.

In addition, the conventional drum type washing machine requires the second drain tube for introducing the washing liquid from the filter to the pump, so the washing liquid should be filled in the second drain tube when the washing cycle is carried out.

SUMMARY OF THE INVENTION

The present invention has been made to overcome the above described problems of the prior art, and accordingly, it is an object of the present invention to provide a drum type washing machine which can not only improve washing efficiency, but also save the washing liquid required for washing the articles to be washed.

To achieve the above object, the present invention provides a drum type washing machine comprising:

a body;

an outer tub for receiving a washing liquid, the outer tub being disposed in the body;

a drum formed at a side wall thereof with a plurality of discharging holes and disposed in the outer tub for receiving articles to be washed; and a first means for spraying the washing liquid onto the articles by circulating the washing liquid discharged from a lower portion of the outer tub to an upper portion of the outer tub, the first means removing impurities from the washing liquid while a washing cycle is being carried out and draining the washing liquid out of the washing machine after the washing cycle is finished.

According to a preferred embodiment of the present invention, the first means includes a pump having a case formed at one side thereof with a hole, first and second ports formed at an upper portion of the case, a third port formed at a lower portion of the case, a motor assembly which is installed at an exterior of the case and has a rotating shaft extending into an interior of the case, and an impeller rotatably coupled with the rotating shaft; a second means detachably coupled to the hole of the case and extended into the interior of the case for removing the impurities contained in the washing liquid discharged from the lower portion of the outer tub; and a spraying nozzle assembly disposed above the drum for spraying the washing liquid circulated by the pump onto the articles placed in the drum.

The outer tub has a discharging tube connected to the first port for draining the washing liquid into the pump, the second port is connected to the spraying nozzle assembly through a circulation tube for circulating the washing liquid into the spraying nozzle assembly, and the third port is connected to a drain tube for draining the washing liquid out of the washing machine.

The second means includes a filter having a cap installed in the hole of the case and a mesh plate integrally formed with the cap and extended into the interior of the case.

The first port is positioned corresponding to a position of the mesh plate so that the washing liquid flowed into the first port passes through the mesh plate.

A first fluid path is formed between the impeller and the second port, a second fluid path is formed between the impeller and the third port, a third fluid path is formed between the second and third ports, a first valve is provided in the second port, and a second valve is provided in the third port.

When the impeller rotates in a clockwise direction, the washing liquid is flowed into the first fluid path so that the first valve is opened for allowing the washing liquid to circulate into the spraying nozzle assembly, and when the impeller rotates in a counter clockwise direction, the washing liquid is flowed into the second fluid path so that the second valve is opened for allowing the washing liquid to drain out of the washing machine.

The drum type washing machine of the present invention sprays the washing liquid onto the articles while the washing cycle is being carried out, so the washing efficiency is improved.

Furthermore, since the filter is integrally formed at one side of the pump, there is no need to provide a fluid path for introducing the washing liquid from the filter into the pump, so not only can the construction of the washing machine be simple, but also the circulating time of the washing liquid can be saved.

BRIEF DESCRIPTION OF THE DRAWINGS

The above object and other advantages of the present invention will become more apparent by describing in detail a preferred embodiment with reference to the attached drawings, in which.

DESCRIPTION OF THE PREFERRED EMBODIMENTS

Hereinafter, preferred embodiments of the present invention will be described in detail with reference to the accompanying drawings.

Figure 1:
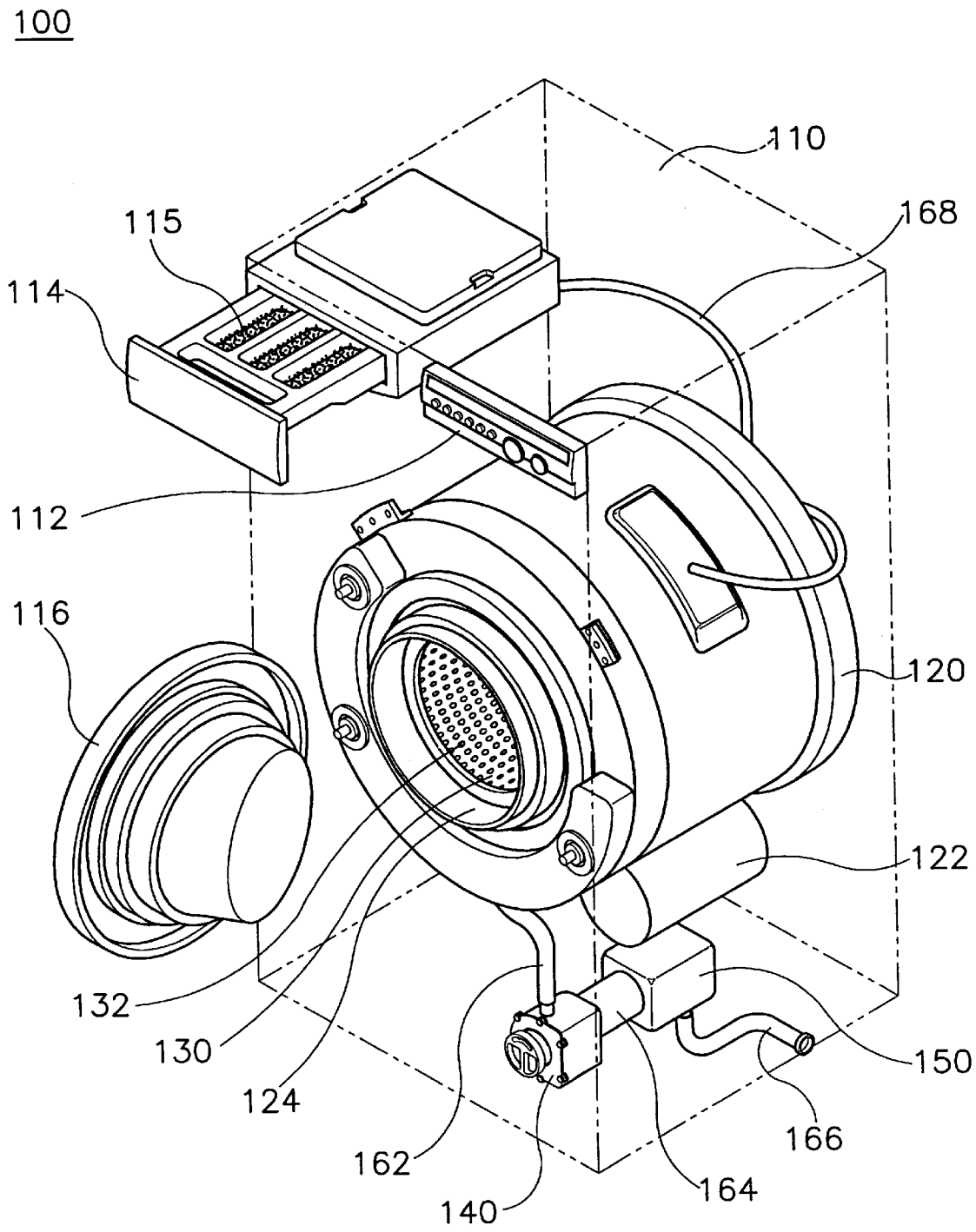
FIG. 1 (PRIOR ART)
FIG. 1 is a perspective view of a conventional drum type washing machine.
Figure 2:
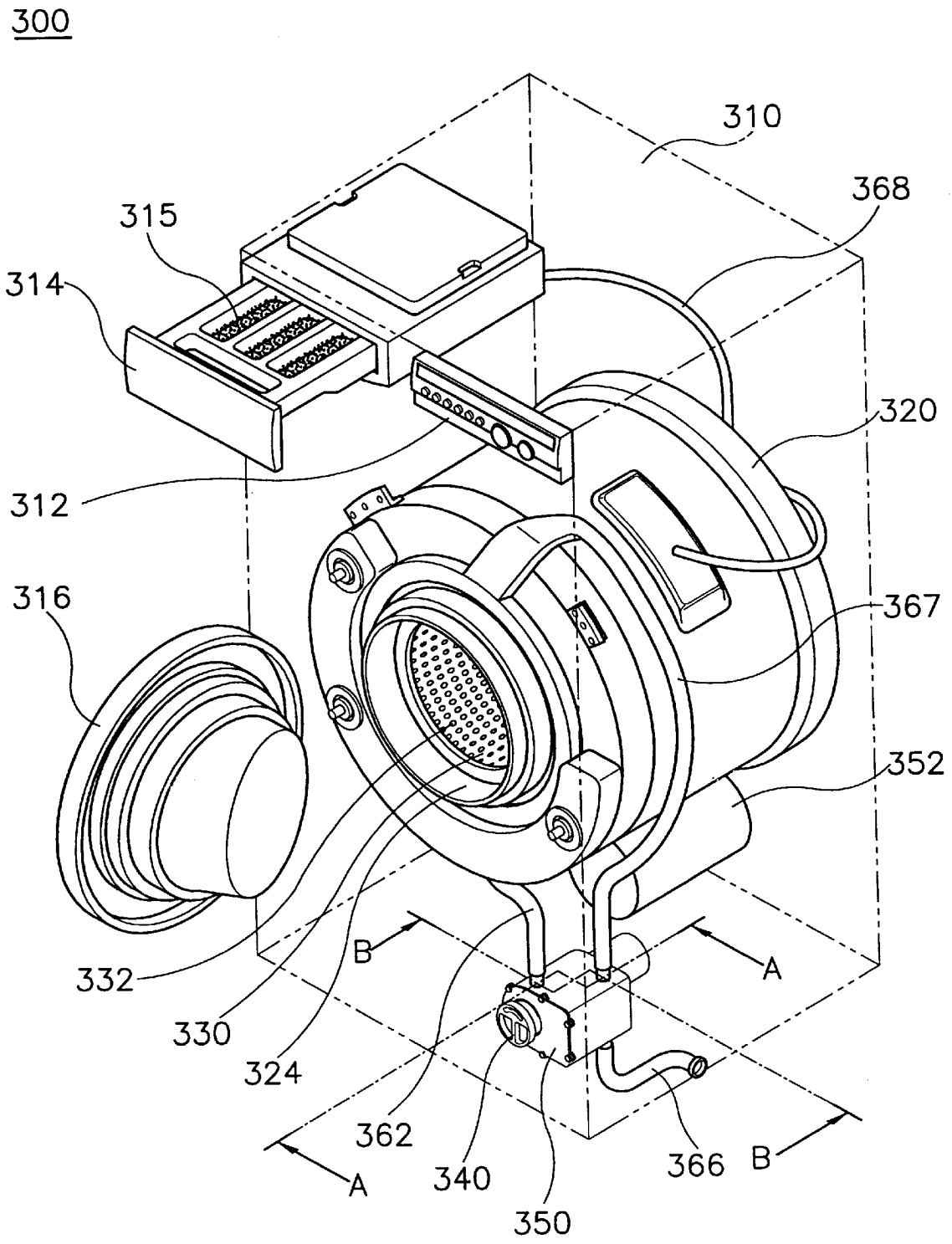
FIG. 2 is a perspective view of a drum type washing machine according to one embodiment of the present invention.

FIG. 2 shows a drum type washing machine 300 according to one embodiment of the present invention.

As shown in FIG. 2, drum type washing machine 300 has a body 310 provided at an upper portion thereof with a control panel 312, an outer tub 320 contained in body 310, a drum 330 rotatably disposed in outer tub 320, and a pump 350 disposed below outer tub 320 for circulating and draining the washing liquid.

A detergent box 314 for storing detergents 315 is installed at the upper portion of body 310. Detergent box 314 is connected to outer tub 320 through a water supplying tube 368. Accordingly, the washing liquid is supplied into outer tub 320 through water supplying tube 368 together with detergents 315.

Outer tub 320 has a cylindrical shape and is formed at one side thereof with an opening 324 which is opened and closed by a door 316. Drum 330 is formed at a circumference thereof with a plurality of holes 332. The washing liquid is flowed into drum 330 through the plurality of holes 332.

A rotating shaft of drum 330 is disposed at one side of outer tub 320 and is connected to a rotating shaft (not shown) of a motor 430 installed below outer tub 320. Accordingly, when the rotating shaft of drum 330 is rotated by motor 430, drum 330 is also rotated.

Drum 330 is disposed at a center of outer tub 320 so that a space is formed between an outer circumference of drum 330 and an inner circumference of outer tub 320. When the washing liquid is supplied into outer tub 320 through water supplying tube 368, the washing liquid is flowed into the space through drum 330. Accordingly, drum 330 is partially immersed in the washing liquid.

Figure 3:
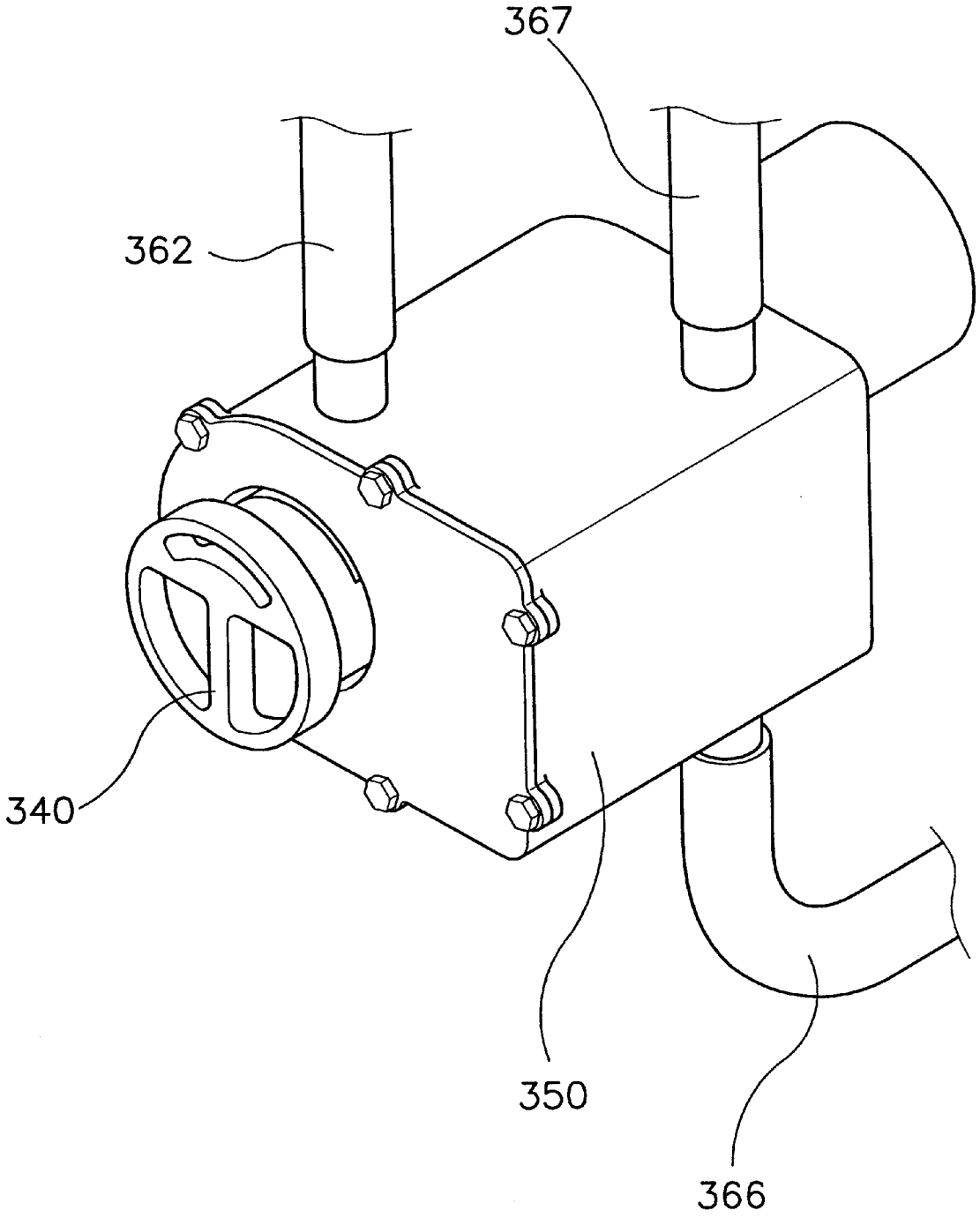
FIG. 3 is an exploded perspective view of a pump shown in FIG. 2.
Figure 4:
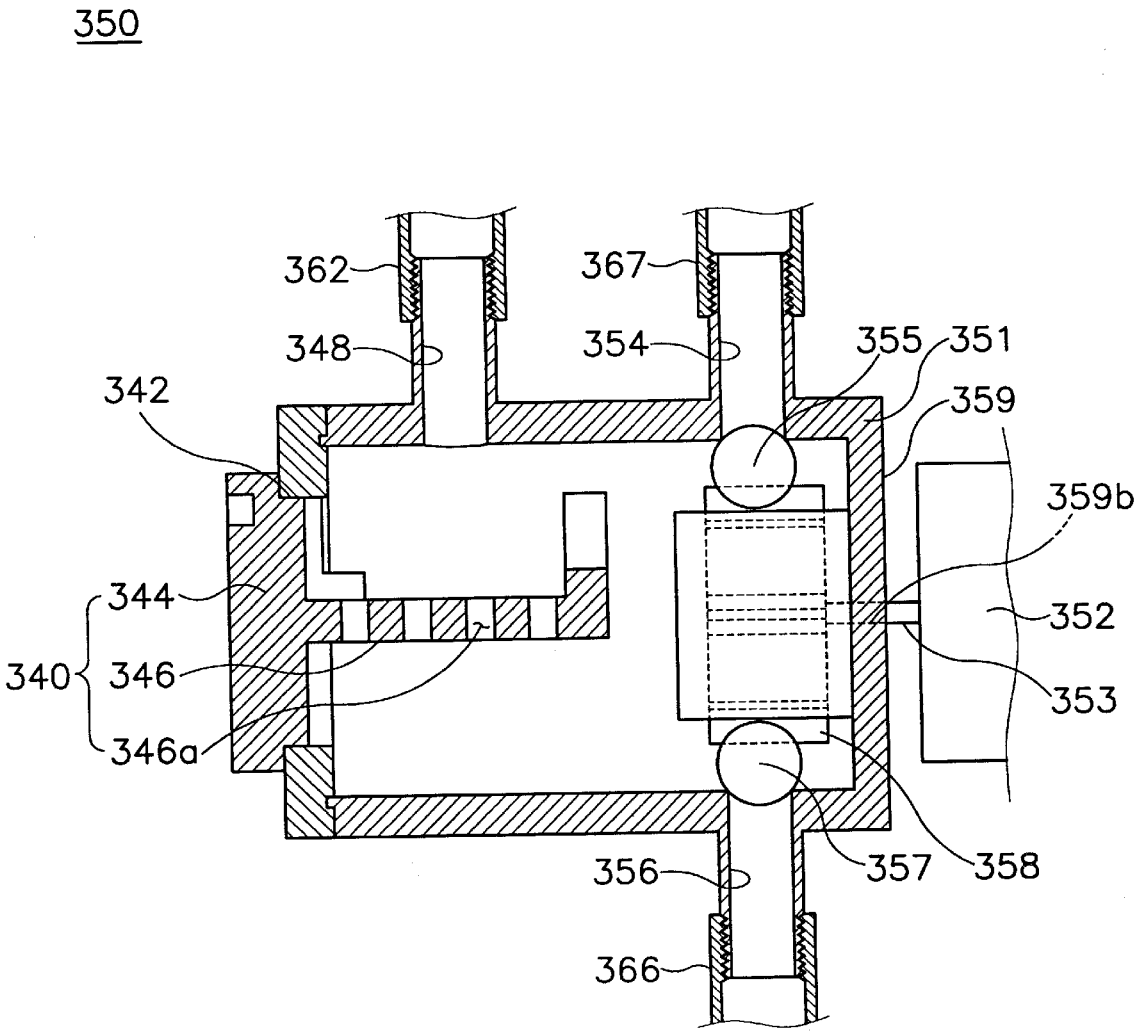
FIG. 4 is a sectional view taken along line A—A in FIG. 2.

Referring to FIGS. 3 and 4, pump 350 is connected to outer tub 320 through a discharging tube 362, and a filter 340 is integrally formed with pump 350 for removing impurities from the washing liquid discharged from discharging tube 362. In addition, pump 350 has an impeller 358 for circulating or draining the washing liquid passing through filter 340.

A circulation tube 367 is connected between pump 350 and an upper portion of outer tub 320 for circulating the washing liquid into the upper portion of outer tub 320. A drain tube 366 for draining the washing liquid is connected to a lower portion of pump 350.

Figure 6:
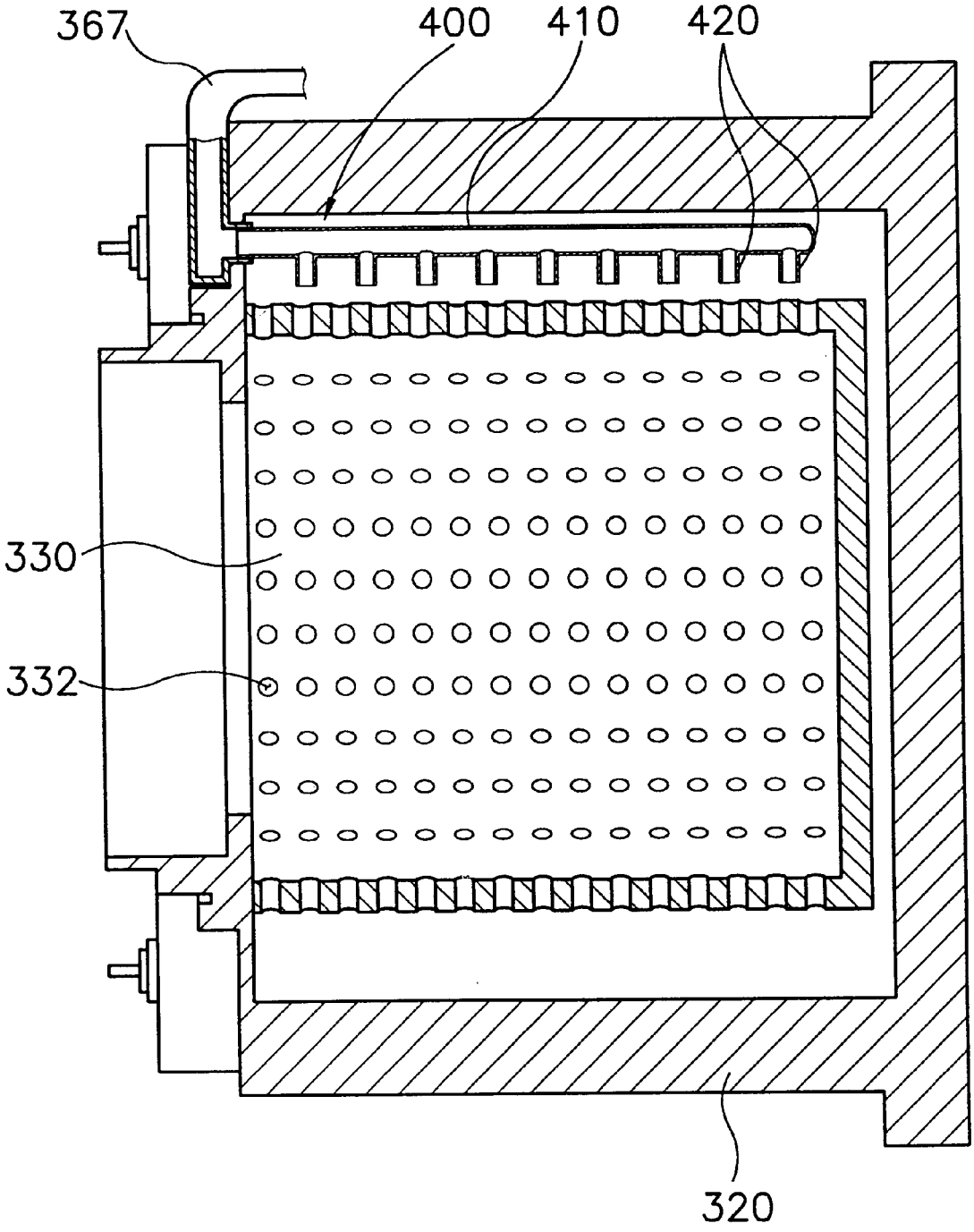
FIG. 6 is a sectional view shown an internal structure of an outer tub.

As shown in FIG. 6, circulation tube 367 is connected to a spraying nozzle assembly 400, which is disposed above drum 330, in order to introduce the washing liquid from pump 350 into spraying nozzle assembly 400. Spraying nozzle assembly 400 includes a hollow plate 410, which is connected to circulation tube 376 and extends in a longitudinal direction of drum 330, and a plurality of spraying nozzles 420 integrally formed at an underside of hollow plate 410.

Hereinafter, the structure of pump 350 will be more detailedly described with reference to FIGS. 4 and 5.

Figure 5:
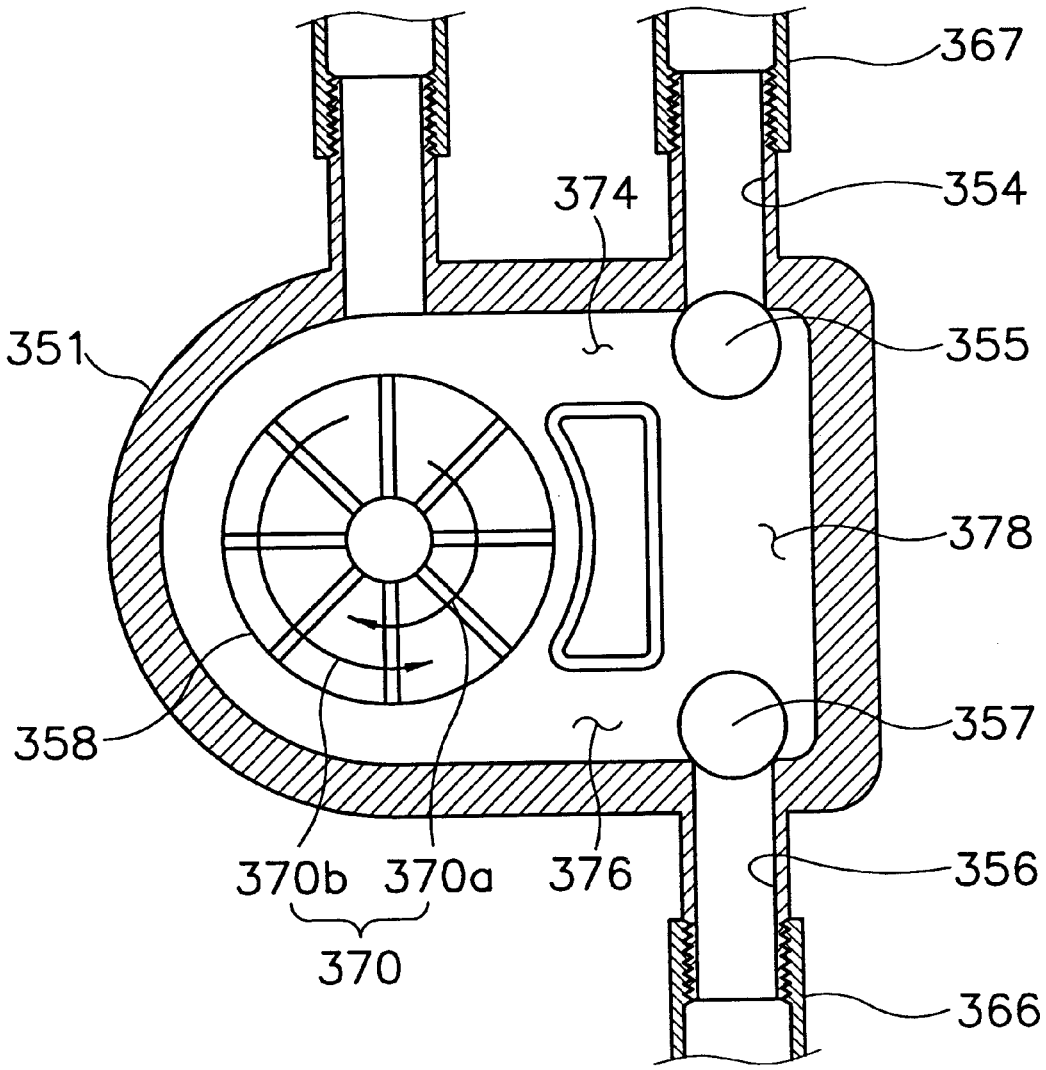
FIG. 5 is a sectional view taken along line B—B shown in FIG. 2.

FIG. 4 is a sectional view taken along line A—A in FIG. 2, and FIG. 5 is a sectional view taken along line B—B shown in FIG. 2.

As shown in FIGS. 4 and 5, pump 350 has a case 351 formed at one side thereof with a hole 342. First and second ports 348 and 354 are formed at an upper portion of case 351 and a third port 356 is formed at a lower portion of case 351. Filter 340 is coupled to pump 350 through hole 342. A rotating shaft 353 of motor assembly 352 extends into an interior of case 351, and impeller 358 is rotatably coupled with rotating shaft 353.

Filter 340 includes a cap 344 installed in hole 342 of case 351 and a mesh plate 346 which is integrally formed with cap 344 and extends into the interior of case 351. Mesh plate 346 has a plurality of pores 346a for filtering the impurities. First port 348 is positioned corresponding to a position of mesh plate 346 so that the washing liquid flowed into first port 348 passes through mesh plate 346. Accordingly, the impurities are filtered while the washing liquid passes through discharging tube 362, first port 348 and filter 340.

Discharging tube 362 is connected to first port 348 for discharging the washing liquid into pump 350. Second port 354 is connected to spraying nozzle assembly 400 through a circulation tube 367 and third port 356 is connected to drain tube 366. Second port 354 is arranged in line with third port 356. In addition, a first valve 355 is provided in second port 354, and a second valve 357 is provided in third port 356.

Preferably, first and second valves 355 and 357 include ball valves which are opened and closed according to a direction of a fluid flow.

At a side wall 359 of case 351, there is formed a hole 359*b* through which rotating shaft 353 of motor assembly 352 is inserted.

Motor assembly 352 is driven in a forward or reverse direction as indicated by an arrow 370. Accordingly, impeller 358 connected to rotating shaft 353 of motor assembly 352 is also rotated in the forward or reversed direction.

A first fluid path 374 is formed between impeller 358 and second port 354, a second fluid path 376 is formed between impeller 358 and third port 356, and a fluid path 378 is formed between second and third ports 354 and 356. Accordingly, the washing liquid flowed into pump 350 is introduced into first or second fluid path 374 or 376 according to a rotational direction of impeller 358.

When impeller 358 rotates in a clockwise direction 370*a*, the washing liquid flows into first fluid path 374 and makes contact with a side portion of first valve 355 thereby urging first valve 355 to move downwardly. So, first valve 355 is opened for allowing the washing liquid to circulate into spraying nozzle assembly 400.

On the other hand, since the washing liquid makes contact with an upper portion of second valve 357, third port 356 is closed by second valve 357.

In addition, when impeller 358 rotates in a counter-clockwise direction 370*b*, the washing liquid flows into second fluid path 376 and makes contact with a side portion of second valve 357 thereby urging second valve 357 to move upwardly. So, second valve 357 is opened for allowing the washing liquid to drain out of washing machine 300.

At this time, the washing liquid makes contact with a lower portion of first valve 355, so second port 354 is closed by first valve 355.

Drum type washing machine 300 having the construction as described above operates as follows.

Firstly, the washing liquid is introduced from a liquid source into outer tub 320. At this time, the washing liquid flows into drum 330 through holes 342 and flows into pump 350 through discharging tube 362.

In this state, motor assembly 352 is driven so that drum 330 rotates and the articles placed in drum 330 makes contact with the washing liquid. At this time, a control section rotates impeller 358 in the clockwise direction.

As mentioned above, when impeller 358 rotates in clockwise direction 370*a*, the washing liquid introduced into pump 350 flows into first fluid path 374 and makes contact with the side portion of first valve 355 thereby opening first valve 355 and closing second valve 357.

As a result, the washing liquid is sprayed onto the articles through second port 354, circulation tube 367 and spraying nozzle assembly 400. Therefore, the articles widely make contact with the washing liquid. The washing liquid is strongly sprayed onto the articles so the detergents contained in the articles are easily dissolved.

When the washing cycle has been finished, the control section rotates impeller 358 in counter-clockwise direction 370*b*.

As mentioned above, when impeller 358 rotates in counter-clockwise direction 370*b*, the washing liquid introduced into pump 350 flows into second fluid path 376 and makes contact with the side portion of second valve 357 thereby opening second valve 357 and closing second valve 355.

As a result, the washing liquid is drained out of washing machine 300 through third port 356 and drain tube 366.

As described above, the drum type washing machine of the present invention sprays the washing liquid onto the articles while the washing cycle is being carried out, so washing efficiency is improved.

Furthermore, since the filter is integrally formed at one side of the pump, there is no need to provide a fluid path for introducing the washing liquid from the filter into the pump, so not only can the construction of the washing machine be simple, but also the circulating time of the washing liquid can be saved.

While the present invention has been particularly shown and described with reference to preferred embodiments thereof, it will be understood by those skilled in the art that various changes in form and detail may be effected therein without departing from the spirit and scope of the invention as defined by the appended claims.

What is claimed is:

1. A drum type washing machine comprising:

a body;

an outer tub for receiving a washing liquid, the outer tub being disposed in the body;

a drum formed at a side wall thereof with a plurality of discharging holes and disposed in the outer tub for receiving articles to washed;

a spraying nozzle assembly disposed above the drum for spraying the washing liquid onto the articles by circulating the washing liquid discharged from a lower portion of the outer tub to an upper portion of the outer tub;

a pump for supplying the washing liquid to the spraying nozzle assembly, the pump having a case formed at one side thereof with a hole, first and second ports formed at an upper portion thereof and a third port formed at a lower portion thereof, a motor assembly installed at an exterior of the case and having a rotating shaft extending into an interior of the case, and an impeller rotatably coupled to the rotating shaft; and a filter detachably coupled to the hole of the case and extended into the interior of the case for removing impurities from the washing liquid while a washing cycle is carried out and draining the washing liquid out of the washing machine after the washing cycle is finished.

2. The drum type washing machine as claimed in claim 1, wherein the outer tub has a discharging tube connected to the first port for draining the washing liquid into the pump, the second port being connected to the spraying nozzle assembly through a circulation tube for circulating the washing liquid into the spraying nozzle assembly, the third port being connected to a drain tube for draining the washing liquid out of the washing machine.

3. The drum type washing machine as claimed in claim 2, wherein the filter includes a cap installed in the hole of the case and a mesh plate integrally formed with the cap and extended into the interior of the case, and the spraying nozzle assembly includes a hollow plate, which is connected to the circulation tube an d extends in a longitudinal direction of the drum, and a plurality of spraying nozzles integrally formed at an underside of the hollow plate.

4. The drum type washing machine as claimed in claim 3, wherein the first port is positioned corresponding to a position of the mesh plate so that the washing liquid flowed into the first port passes through the mesh plate.

5. The drum type washing machine as claimed in claim 3, wherein the second port is arranged in line with the third port.

6. The drum type washing machine as claimed in claim 3, wherein a first fluid path is formed between the impeller and the second port, a second fluid path is formed between the impeller and the third port, a third fluid path is formed between the second and third ports, a first valve is provided in the second port, and a second valve is provided in the third port.

7. A The drum type washing machine as claimed in claim 6, wherein the first and second valves include ball valves which are opened and closed according to a direction of a fluid flow.

8. The drum type washing machine as claimed in claim 6, wherein when the impeller rotates in a clockwise direction, the washing liquid is flowed into the first fluid to path so that the first valve is opened for allowing the washing liquid to circulate into the spraying nozzle assembly, and when the impeller rotates in a counter-clockwise direction, the washing liquid is flowed into the second fluid path so that the second valve is opened for allowing the washing liquid to drain out of the washing machine.

* * * * *